US005638833A

United States Patent [19]

Bowen et al.

[11] Patent Number: 5,638,833

[45] **Date of Patent: *Jun. 17, 1997**

[54] CIGARETTE SMOKE FILTER SYSTEM

[75] Inventors: Larry Bowen, Orangeville; Stanislav M. Snaidr, Mississauga, both of Canada

[73] Assignee: 1149235 Ontario Inc., Toronto, Canada

[ * ] Notice: The term of this patent shall not extend beyond the expiration date of Pat. No. 5,495,859.

[21] Appl. No.: 605,442

[22] Filed: Feb. 26, 1996

Related U.S. Application Data

[63] Continuation of Ser. No. 226,890, Apr. 13, 1994, Pat. No. 5,495,859.

[30] Foreign Application Priority Data

Apr. 14, 1993 [GB] United Kingdom ..... 9307710

[51] Int. Cl.[6] ..... A24F 7/00

[52] U.S. Cl. ..... 131/202; 131/175; 131/187

[58] Field of Search ..... 131/330, 175, 131/185, 186, 194, 331

[56] References Cited

U.S. PATENT DOCUMENTS

| | | | |
|---|---|---|---|
| 43,906 | 8/1864 | Foley | 131/202 |
| 258,255 | 5/1882 | Schleber | 131/202 |
| 973,890 | 10/1910 | Surbrug | 131/202 |
| 1,619,408 | 3/1927 | Ferguson | 131/202 |
| 1,821,267 | 9/1931 | Loesch | 131/202 |
| 1,858,938 | 5/1932 | Raftey | 131/202 |
| 1,897,976 | 11/1933 | Birkholz | 131/202 |
| 2,159,121 | 5/1939 | Alley | 131/202 |
| 2,323,856 | 7/1943 | Tillmon | 131/175 |
| 2,580,974 | 1/1952 | Sutler | 131/187 X |

(List continued on next page.)

FOREIGN PATENT DOCUMENTS

| | | | |
|---|---|---|---|
| 803257 | 1/1969 | Canada | 131/202 |
| 807960 | 3/1969 | Canada | 131/202 |
| 821263 | 8/1969 | Canada | 131/202 |
| 826919 | 11/1969 | Canada | 131/202 |
| 942611 | 2/1974 | Canada | 131/202 |
| 943425 | 3/1974 | Canada | 131/202 |
| 955141 | 9/1974 | Canada | 131/202 |
| 959733 | 12/1974 | Canada | 131/202 |
| 1024457 | 1/1978 | Canada | 131/202 |
| 1044552 | 12/1978 | Canada | 131/202 |
| 1057924 | 7/1979 | Canada | 131/202 |

(List continued on next page.)

*Primary Examiner*—Vincent Millin
*Assistant Examiner*—Charles W. Anderson
*Attorney, Agent, or Firm*—Banner & Witcoff, Ltd.

[57] ABSTRACT

A cigarette smoke filter is provided for use in a smoker's accessory for filtering cigarette smoke, the filter comprises:

a tubular filter normally of micro-fibres for removing particulate material from cigarette smoke and optionally an outer filter layer of activated carbon material or the like for adsorbing gaseous components from the cigarette smoke. The efficiencies of the tubular filters is such to remove substantially all of the particulate and gaseous components from the cigarette smoke so that the filtered smoke stream can be discharged into the surroundings free of any cigarette smoke smell.

7 Claims, 5 Drawing Sheets

U.S. PATENT DOCUMENTS

| | | | |
|---|---|---|---|
| 2,663,300 | 12/1953 | Pinto | 131/202 |
| 2,802,405 | 8/1957 | Krogel | 131/202 |
| 2,881,770 | 4/1959 | Touey | 131/342 |
| 2,966,157 | 6/1960 | Touey | 131/202 |
| 2,986,146 | 5/1961 | Li | 131/202 |
| 3,079,929 | 3/1963 | Mueller | 131/202 |
| 3,101,723 | 8/1963 | Seligman et al. | 131/342 |
| 3,225,390 | 12/1965 | Kistler | 131/202 |
| 3,318,317 | 5/1967 | Sproull | 131/202 |
| 3,327,718 | 6/1967 | Kilburn | 131/202 |
| 3,362,415 | 1/1968 | Ellis | 131/202 |
| 3,368,566 | 2/1968 | Avedikian | 131/202 |
| 3,381,070 | 4/1968 | Sublett et al. | 131/342 X |
| 3,393,120 | 7/1968 | Touey | 131/202 |
| 3,484,322 | 12/1969 | Inskeep | 131/342 X |
| 3,621,851 | 11/1971 | Heskett | 131/202 |
| 3,685,523 | 8/1972 | Labbe | 131/202 |
| 3,685,527 | 8/1972 | Sherrill | 131/202 |
| 3,827,444 | 8/1974 | Khan | 131/202 |
| 3,854,384 | 12/1974 | Naylor | 131/202 |
| 3,882,877 | 5/1975 | Brackmann | 131/202 |
| 4,007,745 | 2/1977 | Randall | 131/202 |
| 4,052,179 | 10/1977 | Kirk | 131/202 |
| 4,062,368 | 12/1977 | Crellin | 131/202 |
| 4,069,297 | 1/1978 | Saito | 131/202 |
| 4,164,230 | 8/1979 | Pearlman | 131/202 |
| 4,198,992 | 4/1980 | Smith | 131/202 |
| 4,200,114 | 4/1980 | Waite | 131/202 |
| 4,274,428 | 6/1981 | Muller | 131/202 |
| 4,285,831 | 8/1981 | Yoshida | 131/202 |
| 4,289,149 | 9/1981 | Kyriakou | 131/202 |
| 4,362,169 | 12/1982 | Calkins | 131/202 |
| 4,369,798 | 1/1983 | Jackson | 131/202 |
| 4,370,988 | 2/1983 | Terasaki | 131/202 |
| 4,570,646 | 2/1986 | Herron | 131/202 |
| 4,602,646 | 7/1986 | Cascalenda | 131/202 |
| 4,630,620 | 12/1986 | Gabriel | 131/202 |
| 4,637,407 | 1/1987 | Bonanno | 131/202 |
| 4,685,477 | 8/1987 | Valdez | 131/202 |
| 4,773,435 | 9/1988 | Ikeda | 131/202 |
| 4,784,892 | 11/1988 | Storey | 131/202 |
| 4,788,988 | 12/1988 | Titus | 131/202 |
| 4,790,332 | 12/1988 | Wallace | 131/202 |
| 4,807,646 | 2/1989 | Sahar | 131/202 |
| 4,809,717 | 3/1989 | Imbery | 131/202 |
| 4,858,627 | 8/1989 | Netschert | 131/202 |
| 4,899,766 | 2/1990 | Ross | 131/202 |
| 4,901,739 | 2/1990 | Benavente | 131/202 |
| 4,904,343 | 2/1990 | Giglia | 131/202 |
| 4,922,931 | 5/1990 | Nare | 131/202 |
| 4,993,435 | 2/1991 | McCann | 131/202 |
| 5,048,545 | 9/1991 | Takagi | 131/202 |
| 5,088,508 | 2/1992 | Duncan | 131/202 |
| 5,131,416 | 7/1992 | Gentry | 131/202 |
| 5,154,192 | 10/1992 | Sprinkel | 131/202 |
| 5,160,518 | 11/1992 | Vega | 131/202 |
| 5,169,528 | 12/1992 | Karbachach | 131/202 |
| 5,190,061 | 3/1993 | Brackmann | 131/202 |
| 5,220,930 | 6/1993 | Gentry | 131/202 |
| 5,265,626 | 11/1993 | Schneider | 131/202 |
| 5,279,731 | 1/1994 | Cook | 131/202 |
| 5,495,859 | 3/1996 | Bowen et al. | 131/202 |

FOREIGN PATENT DOCUMENTS

| | | | |
|---|---|---|---|
| 1063946 | 10/1979 | Canada | 131/202 |
| 1085319 | 9/1980 | Canada | 131/202 |
| 1093414 | 1/1981 | Canada | 131/202 |
| 1100746 | 5/1981 | Canada | 131/202 |
| 1103175 | 6/1981 | Canada | 131/202 |
| 1158515 | 12/1983 | Canada | 131/202 |
| 1196833 | 11/1985 | Canada | 131/202 |
| 1268718 | 5/1990 | Canada | 131/202 |
| 1278659 | 1/1991 | Canada | 131/202 |
| 1311889 | 12/1992 | Canada | 131/202 |
| 62-197123 | 8/1987 | Japan | 131/202 |
| 5-103652 | 4/1993 | Japan | 131/202 |
| WO90/09741 | 9/1990 | WIPO | 131/202 |
| WO90/07941 | 9/1990 | WIPO | 131/202 |

CIGARETTE SMOKE FILTER SYSTEM

This application is a continuation of U.S. patent application Ser. No. 08/226,890 which was filed Apr. 13, 1994 now U.S. Pat. No. 5,495,859 and which is herein incorporated by reference.

FIELD OF THE INVENTION

This invention relates to a cigarette smoke filter for use in a smoker's accessory for filtering cigarette smoke and more particularly to filters as used in smoker's accessories which remove substantially all of the particulate and gaseous components of cigarette smoke for discharge into the surroundings.

BACKGROUND OF THE INVENTION

When a cigarette is smoked, visible smoke is produced, by mainstream smoke spillage, exhale smoke and as well sidestream smoke which is generated by the burning cigarette between puffs. Cigarette smoke is considered objectionable by some persons and has led to no-smoking laws of varying degrees of strictness in certain jurisdictions and environments.

A number of prior proposals have been made with respect to structures which are designed to minimize or eliminate the formation of visible smoke, when a cigarette is smoked. However, no device disclosed in the art known to the applicants provides for not only the substantial elimination of all the visible smoke but also provides the same smoking taste and quality to the smoker as if smoked in the normal way.

Several devices of various degrees of sophistication have been developed to filter sidestream smoke and/or exhale smoke. U.S. Pat. No. 4,052,179 discloses an example of the standard type of ashtray system which draws sidestream smoke through a charcoal filter contained within a fine wire or glass fibre mesh. A deodorant pad may be included on the exhaust side of the system to mask any remaining cigarette smoke odours not removed by the charcoal filter.

Another form of sidestream smoke filter is disclosed in U.S. Pat. No. 4,685,477. A cigarette is inserted in the device which is tubular in shape and is open at each end. When the cigarette is inhaled fresh air is drawn in through an air intake. The lit cigarette is positioned inside the tubular filter. As the cigarette continues to burn, the sidestream smoke permeates the surrounding tubular shaped filter. Because the burning cigarette is housed within the filter, the filter material cannot be affected by heat and is not readily ignited by the cigarette ember. During smoking of the cigarette, the enclosed smoke contaminates the cigarette paper and cigarette tobacco resulting in unsatisfactory taste.

U.S. Pat. No. 4,200,114 discloses a smoker's mask which may be placed on the smoker's face. The system provides for inhale and exhale cigarette smoke where all sidestream and exhale smoke is filtered through a single filter. A complex arrangement of check valve is provided to ensure that all smoke passes through the filter or is contained within an enlarged smoking chamber.

U.S. Pat. No. 4,790,332 discloses a smoker's accessory in which the cigarette is totally housed. Both sidestream and exhaled smoke are filtered by the same filter. The filter usually consists of two layers. An inner filter made of hepa or like material removes particulates from cigarette smoke. The outer layer of the filter is a polyurethane foam or like material impregnated with charcoal for removing odour from the air as it passes from the inside of the device through the filters and into the surroundings.

U.S. Pat. No. 4,899,766 describes a smoke catcher which provides for capture of both the sidestream and exhaled smoke. A fan is used in conjunction with filters to draw the sidestream smoke and exhaled smoke through filters before discharge into the surroundings. The filters comprise in series two or more filter elements. The exhaust fan is located downstream of the filter elements. Alternatively, the exhaust fan may be located to exhaust the smoke to the outside without filtration.

U.S. Pat. No. 4,993,435 discloses a smoker's accessory which captures sidestream smoke for inhalation by the user and is provided with an exhale filter arrangement. Several serially arranged filter disks are provided. The filter disk may include charcoal and the like or pressed paper material having a suitable porosity for purposes of filtering the exhaled smoke.

A filter disk has also been used in a smoker's accessory having a powered fan within the hand-held unit. The sidestream smoke is drawn from the lit cigarette through a filter disk before discharge to the surroundings in the manner shown in U.S. Pat. No. 4,637,407.

Considerable efforts have been made in the area of filters as provided on cigarettes to effect a partial filtration to reduce the amount of tar and nicotine inhaled by the smoker. It is appreciated that cigarette filters however are not designed to remove substantially all of the cigarette smoke so that the smoker continues to experience the usual taste and flavour. Cigarette filters for example, which are tubular in nature are designed to filter some of the smoke particles from the smoke stream. U.S. Pat. No. 3,685,523 discloses a tubular type of cigarette tip filter which partially filters the cigarette smoke as it passes from the interior of the tubular filter to the exterior thereof before inhale by the smoker. A similar type of filter is described in U.S. Pat. No. 3,854,384 involving a tubular filter only offset with respect to the central axis of the cigarette. Both filters are designed to be inefficient to allow the various components of cigarette smoke to pass through the filter so that the smoker realizes the desired taste and flavour.

Canadian Patent 1,057,924 as issued to the applicant describes a method of producing polymefic fibres of micron size which can be used in cigarette filters. Such micro-fibre has been used in cigarette filters of the type described in applicant's U.S. Pat. No. 3,882,877 and international application WO90/09741. The micro-fibres produced by the method of Canadian Patent 1,057,924 have increased filtration efficiency compared to cigarette filters of the standard cellulose acetate, charcoal and the like. In order to take advantage of the efficiency of those filters a thin cylindrical filter is provided in the filter tip of a cigarette as described in WO90/09741 which provides for uniform tar delivery while smoking the cigarette.

None of the devices described in this prior art provides however, in a portable and compact structure, the significant features of substantial elimination of both sidestream and exhale smoke and that the smoker experiences the same degree of smoking taste and quality as when smoking a cigarette normally.

In accordance with this invention, a filter is provided which may be adapted for use in filtering cigarette smoke. The filters are intended to be used with devices such as a compact portable smoker's accessory which permits a smoker to smoke a cigarette while at the same time substantially eliminating at least the sidestream smoke and exhaled smoke. Such device may include an enclosure in which the cigarette is located for smoking. The smoker may draw on the cigarette located within the enclosure to smoke the cigarette and also exhales back into the device where the appropriate filters process either the sidestream smoke or the exhaled smoke.

A fan may be provided in the enclosure to ensure a powered air flow through the enclosure so as to supply fresh air as required for proper burning of the cigarette and also to decrease the temperature of air surrounding the cigarette, so as to prevent scorching of cigarette paper and prevent drawing of the hot air from the enclosure by the smoker which would result in unsatisfactory taste and flavour to the smoker. In this way, the same degree of smoking taste and quality could be maintained as if the cigarette were smoked normally.

Low pressure drop highly-efficient filtration material generally is employed for filtering both sidestream smoke and exhale smoke. Such highly-efficient filtration material generally comprises a mass of micro-free fibres. Such filtration conveniently is effected in separate compartments or the same compartments within the enclosure, by different filter elements.

The filter element or elements may be constructed to permit filtration of cigarette smoke to be effected prior to contact of such smoke with the permanent structural elements of the smoking apparatus, so as to minimize contamination of non-disposable elements of the device by tobacco smoke components.

The smoking apparatus is constructed so that at least the tobacco portion of the cigarette is enclosed within the unit during smoking to ensure that all sidestream smoke is filtered by the unit, and also provides for filtration of exhale smoke such that the activity of smoking is not readily apparent to the casual observer. The smoking apparatus may also be constructed or used without providing for the exhale smoke filtration.

SUMMARY OF THE INVENTION

According to an aspect of the invention, a cigarette smoke filter for use in a smoker's accessory for filtering cigarette smoke derived from sidestream smoke or exhale smoke, the filter comprises:

a tubular filter for removing particulate material from sidestream or exhaled cigarette smoke, said tubular filter having an inlet end for directing sidestream or exhaled cigarette smoke into an end of an elongate chamber within said tubular filter, said tubular filter having a closed end opposite said inlet end to close off said chamber at the opposite end, said tubular filter being of sufficient thickness to remove substantially all particulate components from cigarette smoke passing from said inner elongate chamber through said tubular filter.

BRIEF DESCRIPTION OF THE DRAWINGS

Preferred embodiments of the invention are described with respect to the drawings wherein.

DEFINITIONS

Figure 1:
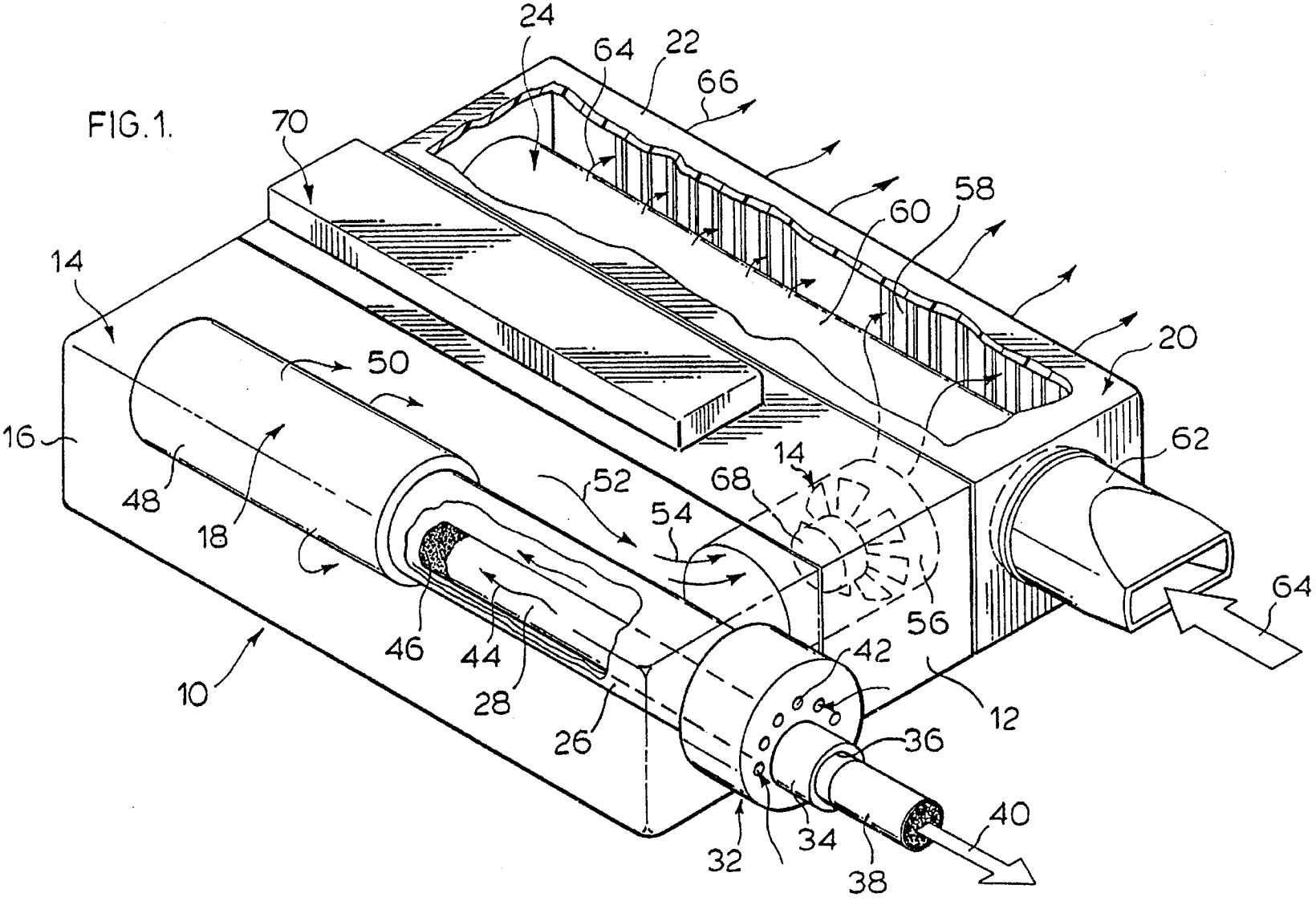
FIG. 1 is a perspective view of a smoker's accessory with sections thereof removed to show the location of filter cartridges which filter sidestream smoke and exhale smoke.
Figure 4:
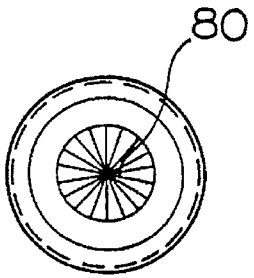
FIG. 4 is an end view of the filter cartridge of FIG. 2.

In order to facilitate a description of the various embodiments of the invention, the following definitions are provided for various components and other aspects as they relate to the invention.

Exhale Smoke means cigarette smoke exhaled by a smoker while smoking a cigarette.

Gaseous Components means the components of cigarette smoke other than particulate components and which, if present in an air stream, provides a detectable smell of cigarette smoke.

Low Pressure Drop means that the material is sufficiently porous to air flow that a pressure drop across the material is sufficiently low that the size of the fan, the power therefor and the exhale pressure are of a nature that the smoker's accessory may be hand held. In order to optimize the accessory design, a low pressure drop is preferably less than about 10 mm $H_2O$.

Micro-fibre means a fibre having an average diameter of about 10 microns or less.

Minimal resistance to air flow means that the filter material or the like provides a very low pressure drop to air passing therethrough.

Non-Porous means that the material does not permit flow of the designated components through the material. For example, if a material is non-porous to smoke particles then smoke particles are prevented from travelling through the material but for example, air could continue to travel through the material.

Particulate Components means the components of cigarette smoke which exist in particle form and are usually of a size less than about 1 micron and normally of a size in the range of about 0.1 to about 0.6 microns.

Porous means that the material is sufficiently open with holes, channels or the like to permit air flow therethrough.

Sidestream Smoke means cigarette smoke which rises from a lit cigarette.

Substantially All, means in respect of removal of smoke particles or gaseous components from cigarette smoke, that there are substantially no visual or gaseous components remaining which can at least be detected by smell.

Suitable Micro-Fibre Forming Composition includes any material which can be formed into micro-fibres and when contacted by cigarette smoke, retains its structure and functional characteristics.

Tube or Tubular means an elongate hollow article which has a sidewall of any desired cross-sectional shape, such as, circular, rectangular, square, triangular, oval, multisided (5 sides or greater) and the like.

DETAILED DESCRIPTION OF THE PREFERRED EMBODIMENTS

The various filter components in accordance with several preferred embodiments of the invention have in common the use of a filter element which is tubular in nature. The tubular filter is preferably made up of micro-fibres of a suitable micro-fibre forming composition which includes materials of mineral, metal, polymer or any other elemental material capable of being formed into the micro-fibres.

In accordance with an aspect of this invention, the filter element may be employed in one configuration with the sidestream smoke filter cartridge or in another configuration as a exhale smoke filter cartridge. The sidestream smoke filter cartridge and the exhale smoke filter cartridge may use in a smoker's accessory particularly of the type that employs a fan to draw sidestream cigarette smoke through the filter cartridge and independently handles the exhale smoke in an exhale filter cartridge which may either be part of or separate from the smoker's accessory for filtering sidestream cigarette smoke.

A representative smoker's accessory is shown in FIG. 1, and is described in applicant's co-pending U.S. application Ser. No. 08/226,864 filed Apr. 13, 1994, the subject matter of which is incorporated herein by reference. The operation of the smoker's accessory may be understood by reference to that application, however, for purposes of describing the function of the filters in accordance with this invention, a brief description is provided of the smoker's accessory as shown in FIG. 1.

The smoker's accessory 10 has a central body 12 which supports and houses a fan 14. Attached to the side of the central homing 12 is a sidestream smoke filtering device 14 which has a housing 16 for a sidestream filter cartridge 18. On the other side of the central body portion 12 is an exhale filter device 20 having a housing 22 for an exhale filter cartridge 24. The device 20 is optionally attached to the side of the central body portion 12. It is understood that the device for filtering sidestream smoke may be held in one hand and the exhale filtering device 20 may be held in the other hand in its own complete housing separate and apart from the sidestream faltering device.

The sidestream smoke filter cartridge 18 comprises a cigarette tube 26 in which a lit cigarette 28 may be placed. The lit cigarette may be inserted in the cigarette tube 26 by pushing the lit cigarette through a cigarette holder 32 which has an insert 34 having a bore 36 therein. The lit end of cigarette 26 is inserted through the bore 36. Preferably, the cigarette 28 has its filter tip portion 38 projecting exteriorally of the cigarette holder 32 to allow the user to inhale cigarette smoke in the direction of arrow 40. In this manner, the user, when using the smoking accessory 10 has the same sensation when placing the cigarette filter 38 in their mouth as they would have in a normal smoking environment. The cigarette holder 32 is provided with a plurality of openings 42 through which fresh air is drawn. The fresh air travels in the direction of arrows 44 along cigarette 28 and over the lit ember 46. The fresh air is drawn through the opening 42 by the operating fan 14. The sidestream smoke as picked up by the fresh air 44 as it travels through the filter element 48 in the direction of arrows 50 and along interior of the housing 16 in the direction of arrows 52 and into the inlet of the fan 14 in the direction of arrows 54. Since the smoke has been filtered of particulate components and optionally of the gaseous components, the fan may exhaust the filtered air through its outlet 56 and through the grill portion 58 of the housing 20. It is understood that if the exhale filtering component 20 is not attached to the sidestream filtering device, the fan 14 may exhaust smoke through its outlet 56 to the surroundings. If the filter element 48 only filters out the particulate material then a second filter element may be provided which removes the gaseous components. That second filter element, which is preferably of activated carbon, may be provided over the filter cartridge 48, at the grill 58 of the exhale filter component 20 or at the outlet 56 for the fan 14.

The exhale filter cartridge 24 has a filter element 60 with a mouth piece 62 attached thereto. The user exhales in the direction of arrow 64 into the mouth piece and the exhaled air travels through the filter in the direction of arrows 64 and then to the surrounding 66 by passage through the grill 58. The fan 14 may be provided with an electric motor 68. In view of the portability of the unit the electric motor 68 may be powered by a rechargeable battery pack 70. A suitable switch may be provided on the central unit 12 for turning the fan on and off. Details of the operation of the smoker's accessory in respect its structure, function and operation is described in more detail in applicant's aforementioned U.S. patent application.

The filter components for both the sidestream smoke filter and the exhale smoke filter are tubular and are preferably cylindrical in shape. The filter material is annular in cross-section and extends the length of the tubular element. The tubular filter element has an elongate chamber into which the smoke is introduced. The purpose of the filter element is to remove substantially all of the particulate material in the cigarette smoke. In view of the compact nature of the filter elements, the filter material is of a highly efficient low pressure drop construction. The tubular filter element is of sufficient cross-section thickness, that is radial direction from the centre of the tubular element, to achieve such particulate component removal from the cigarette smoke as the smoke passes radially from the inner elongate chamber through the tubular filter. Low pressure drop for the material may be determined and measured in a variety of well known techniques such as displacement of measured mm of $H_2O$ in a pressure sensing device. Preferably, the filter material has a low pressure drop in the range of about 5 to about 10 mm of $H_2O$. An alternate measure of pressure drop is Corseta units. The filters of this invention should have a Corseta rating in the range of about 10,000 Cotseta units.

The tubular filter component may comprise a single filter material for only removing particulates. The gaseous components of the cigarette smoke can then be removed by the separate adsorptive-type filtering device located across the entire grill portion 58 of the exhale filter cartridge housing or the fan outlet. Alternatively, the adsorptive material for removing gaseous components from the cigarette stream may surround the exterior of the particulate filter material. The adsorption material is tubular in shape and may contact the inner particulate component filter or may have a larger interior diameter and be spaced from said inner filter. Hence, in the cigarette smoke passing through both filter elements, both the particulate and gaseous components are substantially all removed. In addition, alternative particulate filter material may be provided on the interior of the primary particulate filter material. This innermost material may be coarse in nature to remove the larger particulates before removal of the freer particulates by the next adjacent annular shaped particulate filter.

Figure 2A:
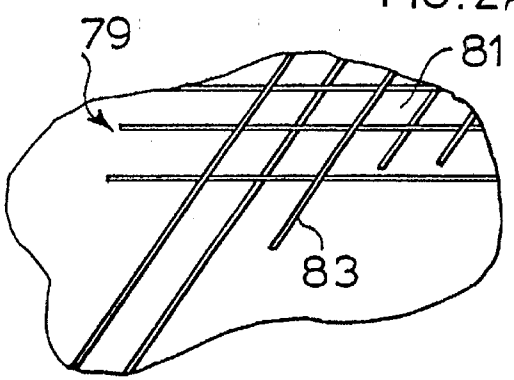
FIG. 2A is an enlarged section of porous mesh used on the filter cartridge of FIG. 2.
Figure 2:
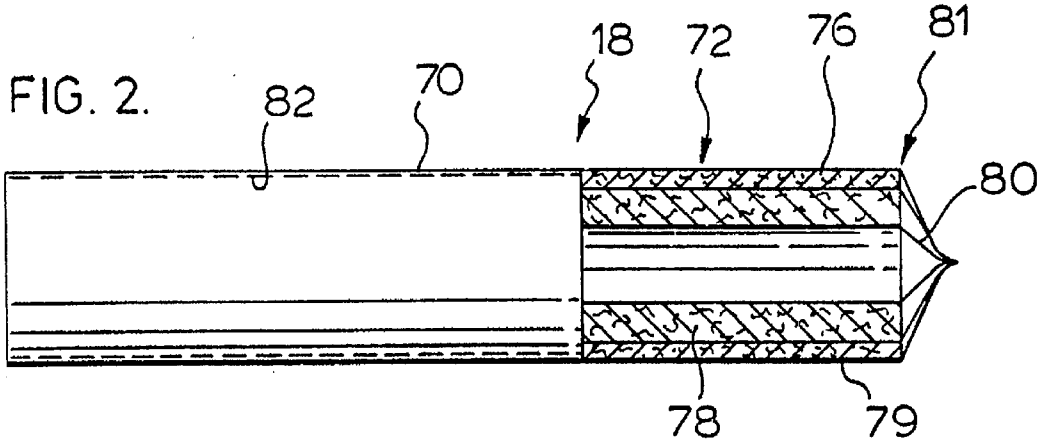
FIG. 2 is a section through a sidestream filter cartridge.
Figure 3:
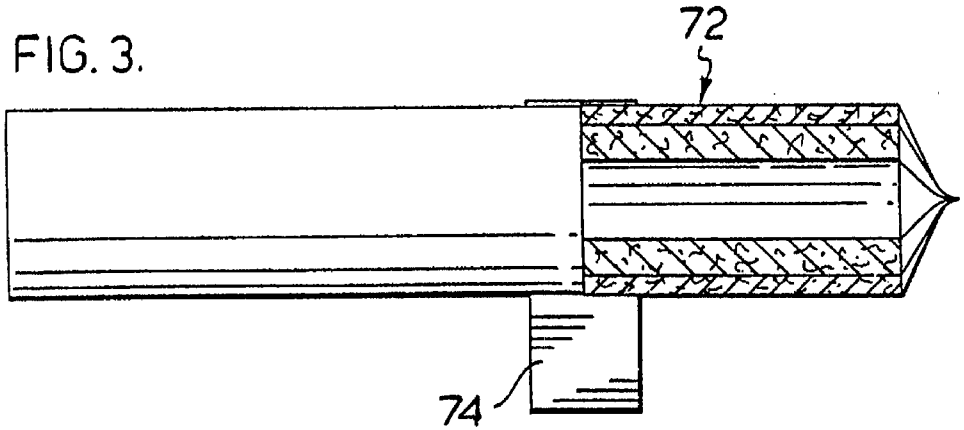
FIG. 3 is another section through the filter cartridge of FIG. 2 showing the assembly thereof.

In accordance with an embodiment of the invention, a suitable filter component for use in the sidestream filter and the exhale filter is shown in FIGS. 2 through 6. With reference to FIGS. 2 and 3 the sidestream smoke filter cartridge 18 comprises a tube 70 of cardboard or similar inexpensive material, within which is located a cigarette for smoking and a closed-end tubular assembly 72 of cigarette smoke filter material attached to the cardboard tube 70 in any convenient manner, such as by cigarette tipping paper 74.

The filter material for the filter element 72 preferably includes a highly-efficient low pressure drop smoke filter material 76 which removes substantially all particulate material from sidestream smoke from a burning cigarette located in the filter cartridge 18, so that only substantially invisible gases pass therethrough. As previously noted, such invisible gases; i.e, the gaseous components, may be removed by an activated carbon filter located elsewhere in the smoking accessory.

The highly-efficient low pressure drop tobacco smoke filter material 76 preferably comprises micro-fine material. Such fibrous material generally has a uniform diameter along its length ranging from about 0.5 to about 10 microns. The micro-fibre material is particularly useful in capturing smoke particles of about 0.2 microns diameter and greater in size. It is understood, however, that the sidestream filter can provide a suitable filtration function with a filter of coarse fibres such as the cellulose acetate fibres. Extra thickness of the coarse filter material would be required to achieve substantially complete removal of the particulate components. The important aspect of the sidestream filter is the provision of the tubular filter on the end of the cigarette tube where the tube is of a special size as described with respect to the embodiment of FIG. 2.

The preferred micro-fine fibre filter material in the filter element 76 may have a thickness of about 0.3 to about 6 mm and a packing weight of about 5 $g/m^2$ to about 500 $g/m^2$ for a sheet thickness in the range of about 0.1 mm to 3 about mm. Preferably the packing weight is in the range of about 10 $g/m^2$ to about 200 $g/m^2$ and in the most preferred applications may only range from about 10 $g/m^2$ to about 50 $g/m^2$. The filter material 76 may be used without any support or may be supported in any convenient manner in the filter element 72, such as by an inner layer of coarse filter material 78, which effects an initial filtration of the sidestream smoke before the micro-fine fibres are encountered. The outer surface of the micro-fine fibre filter element 76 may be supported by a suitable porous mesh material 79 which may be crimped or bunched up in a manner to form a seal at 80 as shown in more detail in FIG. 4. Such seal closes off the distal end 81 of the tubular filter element 76.

The porous mesh 79 may be of plastic which has sufficiently fine openings to retain the micro-fibres. Such mesh may be of the type shown in FIG. 2A. The openings 81 are defined by criss-crossing plastic fibres 83. The fibres 83 are sufficiently flexible to permit holding the filter micro-fibres in the desired cylindrical shape.

The cardboard tube 70 preferably is provided with a lining 82 of charcoal or the like to adsorb condensates from the cigarette smoke and hence assist in the elimination of odour.

The disposable sidestream smoke filter cartridge 18 is intended to be employed for the smoking of one or more cigarettes and then to be discarded. The tubular nature of the assembly ensures that sidestream smoke is filtered before encountering any other part of the apparatus so that the structural elements of the apparatus remain substantially free from condensates from the cigarette smoke and the apparatus can be reused with minimal necessity for cleaning. With reference to an alternative embodiment of the invention of FIGS. 7 to 10, an activated carbon filter is provided around the tubular particulate filter to remove the gaseous components which pass through the inner particulate filter. With that arrangement, cleaning of the unit is essentially eliminated because all cigarette smoke components are captured in the filter element.

Figure 5:
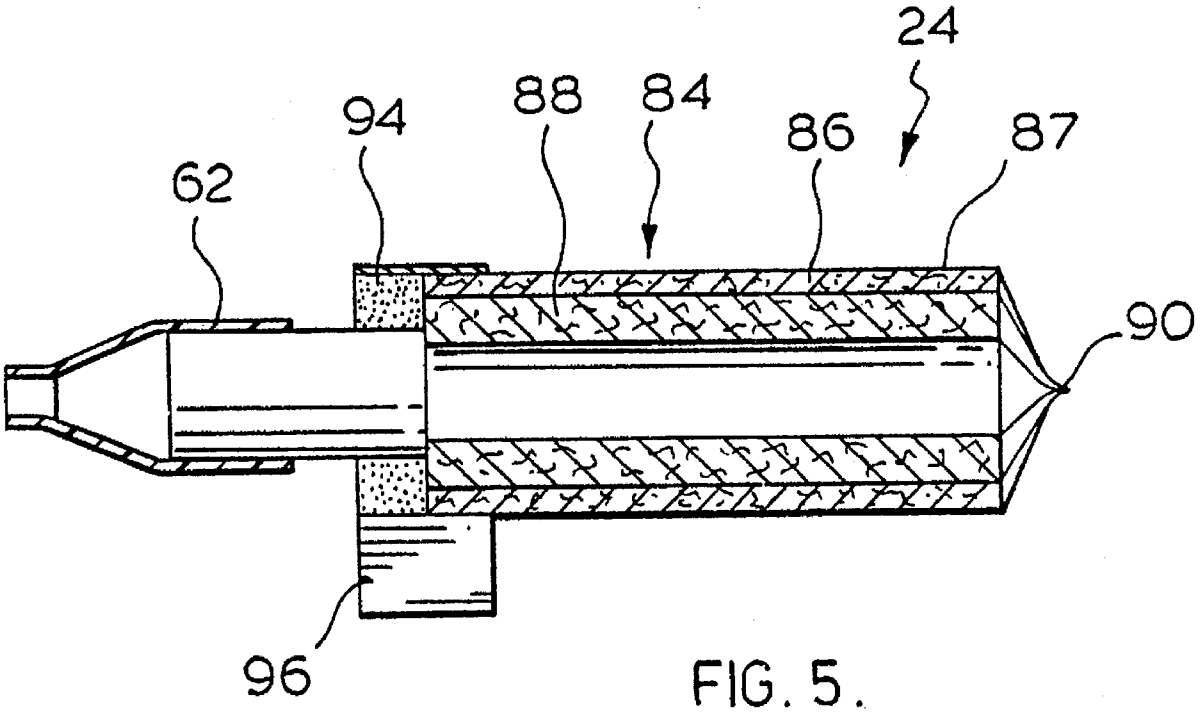
FIG. 5 is a section through an exhale cigarette smoke filter cartridge.
Figure 6:
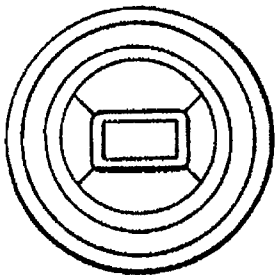
FIG. 6 is an end view of the filter cartridge of FIG. 5.

The exhale filter cartridge 24 of FIGS. 5 and 6, comprises an elongate assembly 84 of a tobacco smoke filter material, similar to that described above for the filter element 72, preferably including a highly-efficient low pressure drop smoke filter material 86 which removes substantially all particulate material from exhaled smoke, so that only substantially invisible gaseous cigarette smoke components pass therethrough. A low pressure drop smoke filter material, such as described above for the filter element 76 may be used. To provide support for the filter element 84, there is provided an inner layer of coarse filter material 88 and an outer porous mesh material 87 like that of FIG. 2A, providing a crimped end closure 90 for the exhale smoke filter element 24. The end closure 90 seals off the end of the filter to ensure that smoke exhaled into the exhale filter travels radially through the filter. The tobacco smoke filter material 88 also may be used without any support.

A replaceable mouth-piece 62 is provided to facilitate exhale of the smoke into the interior of the cartridge 24. A mouth piece holder 94 is joined to the filter structure 84 in any convenient manner, such as by cigarette tipping paper 96. By using such low pressure drop filtration material, there is little resistance to exhale, so that the exhale by the smoker through the filter approximates a normal exhale action. The filtered exhale smoke is discharged through the slots 58 in the side wall of the enclosure 20. The construction of the exhale filter cartridge 24 may be of similar dimensions to the sidestream smoke filter cartridge 18. The construction of the mounting element may be of similar design to the mounting element for the sidestream filter. The dimension of the exhale smoke filter cartridge 24 may be sized to fit inside the tube 70 of the sidestream filter element, to facilitate efficient packing of the elements.

Figure 7:
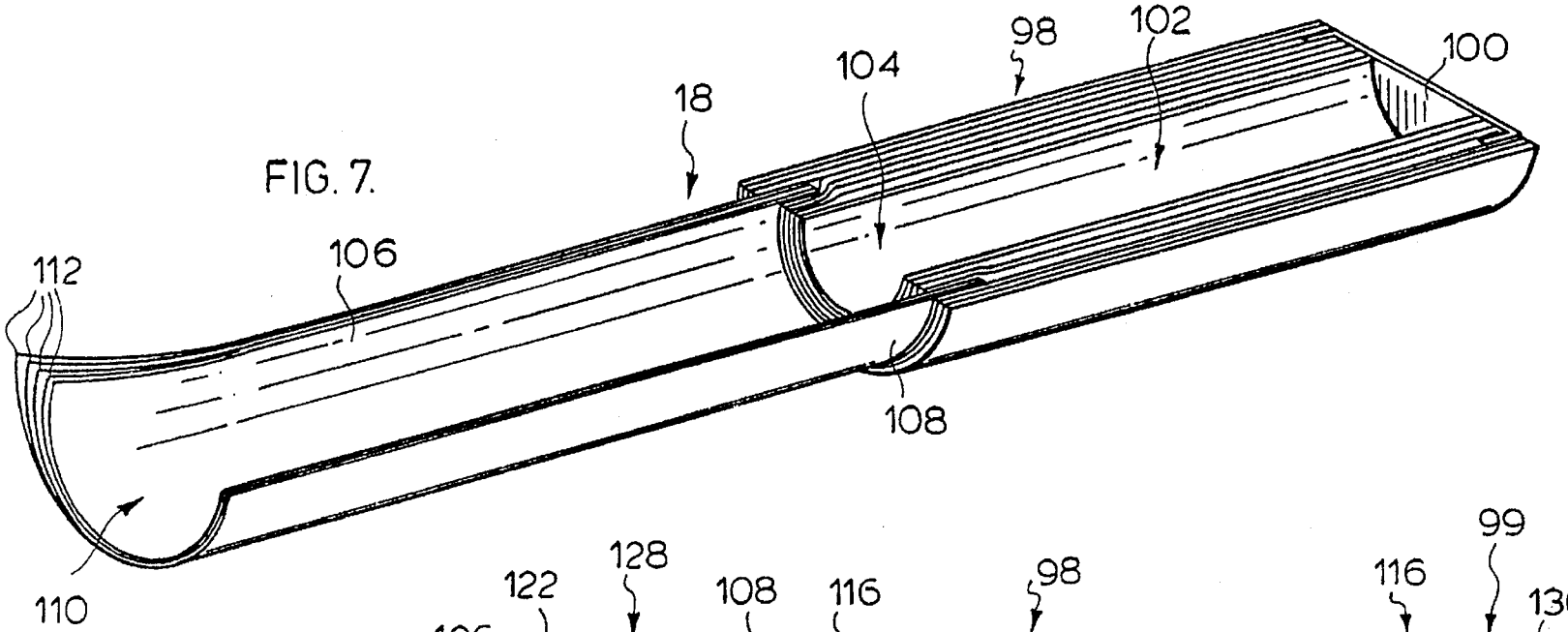
FIG. 7 is a section through a sidestream cigarette smoke filter in accordance with an alternative embodiment of the invention.

A second alternative embodiment for the sidestream and exhale filters is shown in FIGS. 7 through 10. As shown in FIG. 7 the sidestream filter cartridge 18 has a tubular filter element 98 with an end cap 100 which seals the distal end of the filter element. An elongate chamber 102 is provided within the filter element which has an inlet 104. As discussed with respect to FIG. 1, a lit cigarette is placed in the cigarette tube 106. The cigarette tube 106 is connected to the inlet region of the tubular filter at 108. The cigarette tube 106 has an open end 110 to permit insertion of the lit cigarette therein. As shown in FIG. 7, the cigarette tube is preferably made up of multiple layers 112. The multiple layers may be glued together at the end 110 to provide structural rigidity and thereby adapt the end 110 for insertion in an appropriate holder such as the cigarette holder 32 of FIG. 1. It is appreciated that the cigarette tube may be of a single thickness of sheet material or of a single thickness of glass, high temperature plastic or metal.

Figure 8:
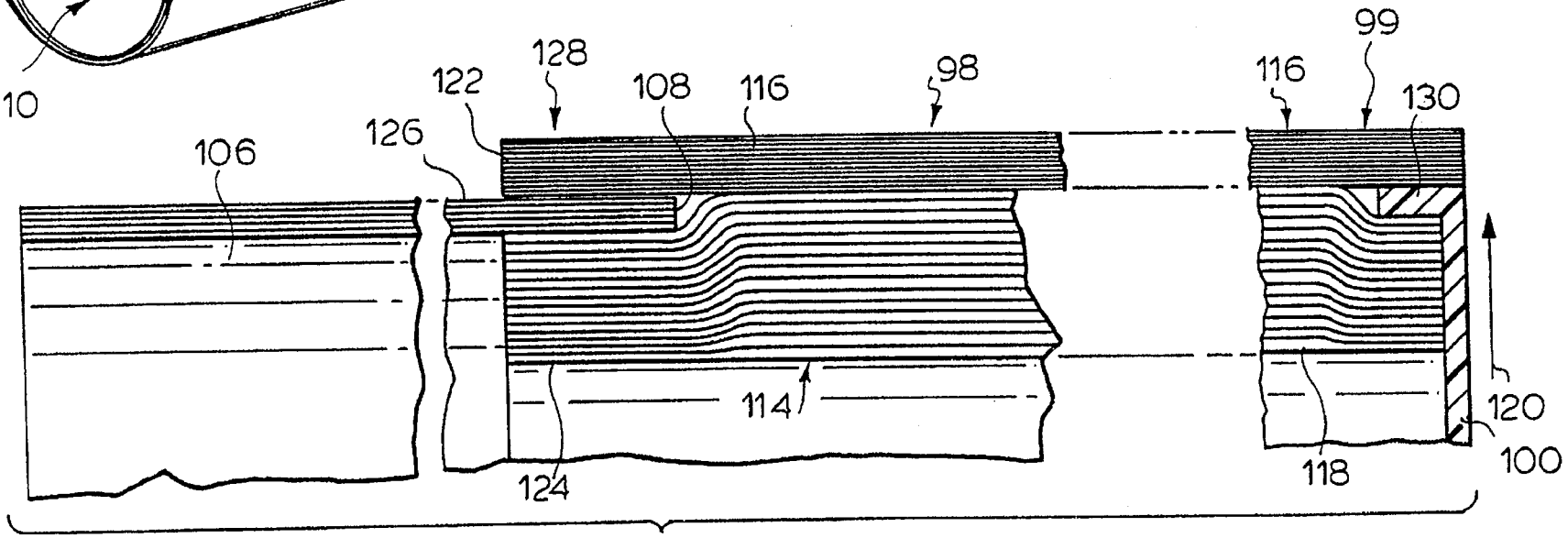
FIG. 8 is an enlarged view of portions of the sidestream cigarette filter of FIG. 7.

As shown in FIG. 8, the tubular filter element 98 comprises an inner filter element 114 and an outer filter element 116. The inner filter element 114 is made up of multiple layers of sheet material 118. The sheet material 118 is layered to form a plurality of layers of filter material in the radial direction, as indicted by arrow 120. The sheet material may be formed of the micro-fibre material described in respect of the high efficiency low pressure drop filter 76 of FIG. 2. The micro-fibre material may be either of a suitable fibre forming composition of mineral, metals, polymers, or any other element capable of being formed into micro-fibres. A suitable polymeric composition is preferably polypropylene, although it is appreciated that there are several other types of polymeric material which may be spun to form the micro-fibres of the layered product. Examples of such additional polymeric materials include polyacrylates, polyamides, polyesters and polystyrenes. The process for forming such micro-fibres are as described in the aforementioned applicant's issued Canadian Patent 1,057,924. The process by which those fibres are formed into a suitable layer is described in Canadian Patents 1,278,659 and 1,311,889.

The alternative embodiments for the filter element, as described with respect to FIG. 2 and FIG. 8 have somewhat different efficiencies. It has been found that a single layer of the micro-fibre material 76 of FIG. 2 is not as efficient as the multiple layers of micro-fibre material 118, of FIG. 8. By virtue of layering the micro-fibre sheet material, the filtering action is substantially enhanced for a given radial thickness to remove for a specific radial thickness substantially all of the particulate material thereby only leaving the gaseous components to be removed by the outer filter 116.

The second filter component which surrounds the first filter component is preferably made of activated carbon to adsorb the gaseous components not trapped by the inner filter element 114. It is appreciated that the outer filter element 116 may however be made of other types of material for adsorbing gaseous components such as zeolite materials sold by Union Carbide under the trade mark Silicalite and as previously used in cigarette filters such as in U.S. Pat. No. 3,327,718. When powdered Silicalites, activated carbon and the like is used the outer filter 116 may be formed by holding the powdered material around the inner filter by a porous mesh of FIG. 2A or the like. Although the mesh is porous to air flow, it is impervious to the powdered material to retain thereby the powdered material in the desired shape.

The preferred outer filter material is made of activated carbon fibre which is provided in sheet form. The outer filter element 116 may be made in the form a single sheet of a desired thickness or alternatively, the sheets 122 may be layered onto itself as shown in FIG. 8 to develop the desired thickness for the outer filter element 116. The activated carbon fibres for the sheets 122 may be obtained from various sources of supply, for example, from Futamura Chemical Industries of Nagoya, Japan.

The cigarette tube 106 has its innermost end 108 secured between the outer filter element 116 and the inner filter element 114. The layers 118 are compressed to some extent in region 124 such that they can be positioned within the inside of the inner end 108 of the tube 106. The outer filter element 116 is then positioned on the outside 126 of the cigarette tube 106. Preferably, adhesive is used to adhere end 108 to the inner filter element in region 124 and the outer filter element in region 128.

The cigarette tube 106 is preferably formed of layers of sheet material 112. The layered tube 106 has sufficient structural rigidity such that when the open end 110 is secured to the cigarette holder 36 of FIG. 1 the tube is suspended within the housing of the smoker's accessory.

It is appreciated that the layers for the cigarette tube 106 may be formed of a variety of materials. It is also appreciated that the cigarette tube may be made from a single layer of material which may have a thickness equivalent to the thickness of the multiple layers 112 for the cigarette tube. The preferred material for the cigarette tube 106 is a plurality of overlaid sheets of carbon filled paper. The carbon filled paper may or may not contain a fire retardant to inhibit ignition of the carbon paper by the glowing cigarette. There are several suppliers of carbon paper which may or may not include a fire retardant. The carbon paper typically has a thickness in the range of 0.1 to 2 mm and is non-porous to the cigarette sidestream smoke. That is, when the cigarette is burning within the cigarette tube smoke cannot escape through the cigarette tube so that all sidestream smoke as emitted by the burning cigarette must pass through the filter element 98. It is appreciated that such carbon paper may be porous to air unlike the alternate structures such as the glass tube. In accordance with a preferred embodiment of the invention, it has been found that a marginal porosity to air for the cigarette tube is beneficial. That is, the tube material is porous to air under high pressure which equates to a high pressure drop across the material, but continues to be non-porous to the cigarette smoke particulate components and gaseous components. Although the success in a slight porosity for the cigarette tube is not completely understood, it is thought that the hot gases developed within the tube can escape to some extent while leaving the cigarette smoke components within the tube to be drawn away by the fan. The degree of porosity for the tube relative to the filter element is slight; for example, in Corseta units, the carbon paper cigarette tube has a porosity in the range of about 20 to about 50 Corseta units whereas the filter element has a porosity in the range of about 10,000 Cotseta units. We have also determined that the cigarette tube ranges in diameter from about 1.5 times the diameter of the cigarette and greater. It has been found that for cigarette tubes having diameters less than about 1.5 times the diameter of the cigarette, the tube material is hence to close to the lit cigarette and charring or overheating of the cigarette occurs which leads to unsatisfactory smoke taste. In view of the tube cross-section being of a variety of shapes it is understood that diameter for the tube is intended to cover the average width dimension of the tube interior.

A cap 100 is provided to close the end 99 for the filter element 98. The cap 100 has an annular ridge 130 which is positioned between the inner filter element 114 and the outer filter 116. The annular portion 130 may be secured between the inner and outer filter elements by a suitable adhesive. Preferably the outer filter element 116 extends beyond the inner element 114, the thickness of the cap 100 so as to provide a flush end for the sidestream filter cartridge.

Figure 9:
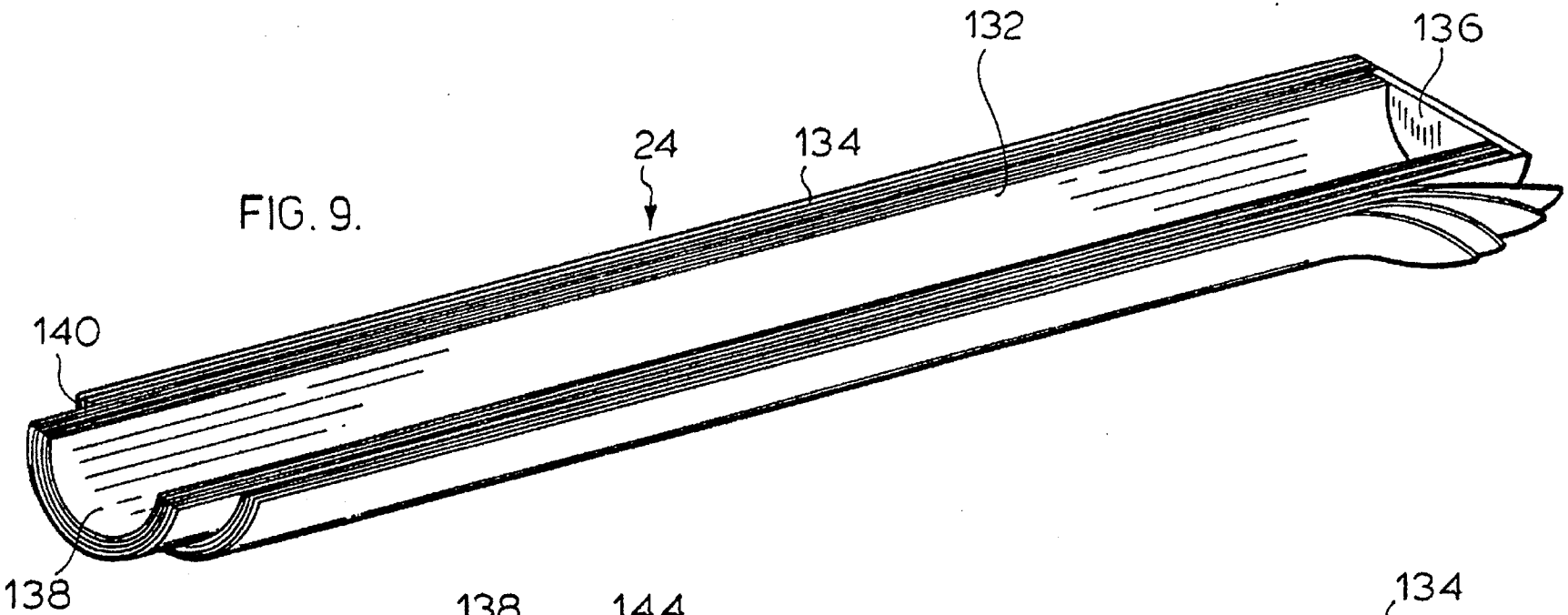
FIG. 9 is a section through an alternative embodiment for a cigarette exhale smoke filter cartridge.

FIG. 9 shows an alternative embodiment for the exhale filter 24. The exhale filter has an inner filter element 132 and an outer filter element 134. The exhale filter element 24 has its distal end closed by a cap 136 which may fit between the inner and outer filter elements and be shaped as per the cap 100 of FIG. 8. The cap 136 may be glued in position where the outer filter element 134 extends beyond the inner filter element 132, the thickness of the cap to provide a flush end for the filter element 24. The inner filter element 132 may be formed of the same micro-fibre material used in the inner filter element of FIG. 8. Similarly, the outer filter material 134 may be formed from a sheet of activated carbon fibre used in the outer filter element 116 of FIG. 8. Also, the several alternatives for the inner and outer filter materials, described with respect to FIG. 8 may also be used in the exhale filter of FIG. 9.

Figure 10:
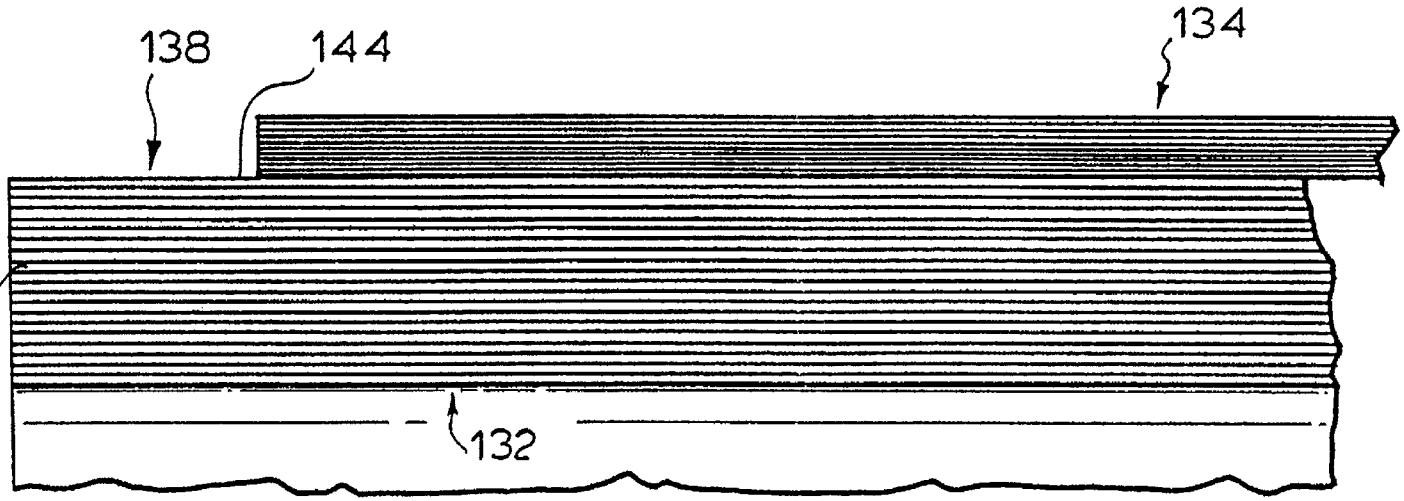
FIG. 10 is an enlarged view of an end of the exhale filter cartridge of FIG. 9.

The inner tubular filter 132 has an inlet end 138 which extends beyond the end portion 140 of the outer filter. This inlet end portion 138 is shown in more detail in FIG. 10. The layers 142 of the inner filter 132 may be adhered together or may be encased in an outer ring 144 to give that projecting portion 138 sufficient structural integrity such that it may be inserted in a suitable mouth piece such as mouth piece 62 of FIG. 1. As shown in FIG. 10, the inner layers 142 of the micro-fibre material are considerably thinner than the outer layers of the activated carbon fibre material.

The size and packing weight of the inner filter material for the embodiments of FIGS. 7 and 9 may be in the same range as with the inner filter material of FIG. 2; that is, a total thickness in the range of about 0.3 mm to about 6 mm and a packing weight in the range of about 5 $g/m^2$ to about 500 $g/m^2$ based on the total thickness. The individual sheets of material may have a thickness in the range of about 0.1 mm to about 3 mm. The preferred ranges for the packing weight is in the range of about 10 to about 200 $g/m^2$ for sheet thickness of about 0.15 to about 3 mm and the especially preferred range of packing densities in the range of about 10 $g/m^2$ to about 50 $g/m^2$ for sheet thickness of about 0.15 to about 0.3 mm. The micro-fibre material as used in the inner filter is especially useful in removing cigarette smoke particles as small as about 0.2 microns in size. The preferred size for the micro-fibres in the inner filter is in the range of about 0.5 to about 2.5 microns. The sufficient radial thickness of the carbon fibre filter is normally in the range of about 1 mm to about 7 mm.

The micro-fibre material of the filter elements of the various embodiments of the invention are particularly efficient in the removal of particulates having sizes in the range of about 0.2 microns and greater. It is appreciated that in varying the thickness of the fibre the entire range of smoke particulates can be removed even including those having sizes less than about 0.3 microns. Although the principle of filtration by the micro-fibres is not very well understood, it is thought that the diameter of the particles of the cigarette smoke are in the range of about 0.1 to about 0.6 microns. The small diameter micro-fibres used in the filter avoid displacement in the direction of travel of the particles such that they collide directly with the micro-fibres and are then held by the micro-fibres. This is in contrast to the normal thicker fibres typically employed in conventional cellulose acetate filters. Those fibre sizes are normally in range of about 10 to about 25 microns which causes a displacement in the air flow around the fibre so that the particles are diverted from colliding directing with the fibres. This has been demonstrated by testing on several occasions where filter material of the significantly thicker diameter fibres is far less effective in removing the smaller particulates than the micro-fibre material having diameter sizes in the range of about 0.1 to about 10 microns and preferably less than about 5 microns. In some applications the preferred fibre size may range from about 0.5 to about 2.5 microns.

A further alternative for the filter embodiments of FIGS. 7 and 9 is spacing the outer tubular filter element 116, for example, of activated carbon from the inner filter element 114. The ends of the filter element 98 would be appropriately sealed to direct all gaseous components through such annular space and into the outer filter. Such annular space may be filled with suitable oxidizing catalysts to degrade the smoke gaseous components before passing through the outer carbon filter.

The alternative of a course filter element, inside the micro-filter element as described with respect to FIG. 2 may be used as well with the layered micro-fibre 114. Such coarse filter element may be of standard cellulose acetate fibres having diameters in the range of about 20 μm. The coarse filter element removes the coarse smoke particles of cigarette ash and the like in advance of the micro-fibre filter. It is, of coarse, appreciated that the cigarette ash which remain within the filter element may be dumped out of the sidestream filter element, or retained in the sidestream filter element until time for replacement. It has been found that leaving cigarette ash in the filter element does not detract from filter efficiency when either the coarse fibre or micro-fibre filter elements are innermost of the inner elongate chamber.

The sidestream and exhale filter cartridges in accordance with this invention may be employed in various types of smoker's accessories which have provision for drawing the sidestream smoke through the filter element by allowing fresh air to enter the inlet end of the cigarette tube. Similarly, the exhale filter cartridge may be used with the smoker's accessory which filters sidestream smoke or may be used independently of that other accessory. The exhale filter may be individually hand held and brought to the mouth whenever exhale of cigarette smoke is desired. The exhale filter cartridge is as shown in FIG. 9 compared to FIG. 7 is considerably larger to provide the least amount of pressure drop so that one may exhale into the filter in an almost normal manner as though they were exhaling into the surroundings. Preferably the low pressure drop for the exhale filter is in the range of about 0.5 mm to about 10 mm of $H_2O$. In view of the filter cartridges being replaceable in a smoker's accessory or the like, it is understood that the filter cartridges may be sold separately of the smoker's accessory. The cartridges may be sold in packages of 5 or 10 and may be sold in conjunction with the cigarettes. Preferably the filter cartridges are capable of filtering cigarette smoke from up to about 20 to 25 about cigarettes, hence only requiring replacement of the filter cartridges with every pack of cigarettes smoked.

Although preferred embodiments of the invention are described herein in detail, it will be understood by those skilled in the art that variations may be made thereto without departing from the spirit of the invention or the scope of the appended claims.

We claim:

1. A cigarette smoke filter for use in a smoker's accessory for filtering sidestream smoke, said filter comprising:

a tubular filter for removing particulate material from sidestream or exhaled cigarette smoke, said tubular filter having an inlet end for directing sidestream or exhaled cigarette smoke into an end of an elongate chamber within said tubular filter, said tubular filter having a closed end opposite said inlet end to close off said chamber at the opposite end, said tubular filter being of sufficient thickness to remove substantially all particulate components from cigarette smoke passing from said inner elongate chamber through said tubular filter.

2. A cigarette smoke filter of claim 1 wherein said filter has multiple layers of different filter material, and comprises:

an inner filter within said tubular filter, said inner filter being tubular in shape and comprising a coarse filter material for removing larger smoke particles.

3. A cigarette smoke filter of claim 1 wherein said filter has multiple layers of different filter material, and comprises:

an outer filter shell surrounding said tubular filter, wherein said outer filter shell is porous to air flow, comprises activated carbon in a support matrix, and exhibits a sufficient radial thickness to absorb substantially all gaseous components of cigarette smoke from cigarette smoke passing therethrough.

4. A cigarette smoke filter of claim 3 further comprising:

an inner filter within said tubular filter, said inner filter being tubular in shape and comprising a coarse filter material for removing larger smoke particles.

5. A cigarette smoke filter of claim 3 wherein said outer filter shell comprises activated carbon held in place about said inner filter by a mesh support.

6. A cigarette smoke filter of claim 3 wherein said outer filter shell comprises activated carbon in the form of a mat of activated carbon fibers.

7. A cigarette smoke filter of claim 6 wherein said mat is wrapped onto itself to form said sufficient radial thickness.

* * * * *